United States Patent [19]

Hargraves

[11] Patent Number: 4,781,382

[45] Date of Patent: Nov. 1, 1988

[54] GOLFING AID

[76] Inventor: Lawrence J. Hargraves, 2271 E. Chevy Chase Dr., Glendale, Calif. 91206

[21] Appl. No.: 26,971

[22] Filed: Mar. 17, 1987

[51] Int. Cl.[4] ..... A63B 69/36

[52] U.S. Cl. ..... 273/183 B; 273/183 D; 273/165; 273/194 R; 273/163 A

[58] Field of Search ..... 273/32 H, 162 R, 194 R, 273/77 R, 81.2, 166, 186 C, 81.3, 81 C, 81 D, 183 D, 183 B, 165, 163 R, 163 A, 164

[56] References Cited

U.S. PATENT DOCUMENTS

| | | | |
|---|---|---|---|
| 760,161 | 5/1904 | Smith | 273/77 R |
| 792,631 | 6/1905 | Taylor | 273/77 R |
| 1,919,221 | 7/1933 | Janes | 273/81.3 |
| 2,204,974 | 6/1940 | Strasser | 273/81.3 |
| 2,273,416 | 2/1942 | Norwood | 273/166 |
| 2,938,728 | 5/1960 | Green | 273/81.3 X |
| 3,273,893 | 9/1966 | Duncan | 273/194 R |
| 3,951,416 | 4/1976 | Koch et al. | 273/183 D |
| 4,170,356 | 10/1979 | Banks | 273/186 C |
| 4,210,334 | 7/1980 | Lind | 273/162 R |
| 4,252,317 | 2/1981 | Vezina | 273/81.2 |

FOREIGN PATENT DOCUMENTS

| | | | |
|---|---|---|---|
| 0023431 | 2/1977 | Japan | 273/81.3 |
| 424666 | 2/1935 | United Kingdom | 273/162 R |

*Primary Examiner*—George J. Marlo
*Attorney, Agent, or Firm*—Louis L. Dachs

[57] ABSTRACT

The invention is a device for aiding a golfer to properly stroke the ball with a putter. In detail, the invention comprises a support member for detachably mounting to the gripping portion of the putter at substantially the end thereof. A generally linear arm is rotatably attached to the support member which, when in use extends outward from the shaft in a direction at right angles to and in the opposite direction of the striking surface of the putter. The arm being rotatively mounted, can be rotated downward in alignment with the longitudinal axis of the shaft when storing the putter. Preferably, a detent is incorporated which releasably positions the arm in the extended position or the retracted position.

10 Claims, 1 Drawing Sheet

GOLFING AID

TECHNICAL FIELD

The invention relates to the field of teaching aids for golfers and particularly to a devise to aid the golfer in achieving a better putting stroke.

BACKGROUND INFORMATION

When putting, the position of the feet, hand grip, are all important. Also of importance is the actual putting stroke. The stroke must be smooth in both the back and forward movement and lie in the plane of the desired initial path of the ball. It is with this latter requirement a smooth, directionally controlled stroke that the golfing aid is directed.

An early attempt to obtain proper alignment of the stroke is disclosed in U.S. Pat. No. 792,631 "Golf Club" by F. W. Taylor. Taylor discloses a "Y" shaped putting club. When using this club the golfer directly faces the hole with his feet apart straddling the ball. The arms of the "Y" have small extensions thereon, which nest in the crook of the golfer's arms. The golfer grasps the club at the junction of the arms and the leg and swings the club in a pendulum like motion with the rotation point being the extensions on the arms of the club. Thus, the forearms rotate about the elbow with the club swinging back between the golfer's legs and then forward to strike the ball. However, while this club provides an ideal putting stroke, such clubs are generally not allowed in tournament play. Furthermore, the rules of golf now require that the golfer stand to one side of the ball. He may not straddle it.

Another approach to obtaining the proper stroke is disclosed in U.S. Pat. No. 760,161 "Golf Club" by H. P. Smith. Here a handle is fastened to the gripping end of the club which extends in a plane parallel to the striking surface of the club head. Thus, when putting, the golfer can grip both the shaft of the club and the handle. However, such a handle would also not be allowed in tournament play.

Another device to aid the golfer in putting is disclosed in U.S. Pat. No. 4,252,317 "Putter" by C. Vezina. A handle is rotatively mounted to the club shaft again in a plane parallel to the striking surface of the club head. With the handle rotatably mounted to the shaft the handle becomes the pivot point for the club, thus providing a pendulum action. Again, this club is not usuable in tournament play.

In addition, to the illegality of the above putters for tournament play, these clubs require the golfer to assume nonconventional stances and grips, etc., which most golfers find unacceptable. However, there have been devices produced to aid the golfer in making conventional swings with conventional clubs. For example, U.S. Pat. No. 2,273,416 "Golf Instruction Device" by J. W. Norwood discloses a devise to help a golfer perfect a conventional grip, (the foreward hand above the rear hand) and stroke. The device consists of a guide member which rests against the shaft of the club and has an extension therefrom which terminates in a band which fasteners around the wrist of the golfer. With the device attached to the wrist of the rear arm and the member in contact with the golf shaft, the shape and dimensions of the device are such that the desired angular disposition of the club to the wrists and hands of the golfer are properly positioned. While such a device could possibly aid the golfer, most would find having such a device attached to the wrist unacceptable, even when practicing.

Thus, with the prior art cited above in mind, it is a primary object of the subject invention to provide a device to aid the golfer to properly stroke the ball when using a conventional putter and putting stroke.

It is another primary object of the subject invention to provide a device that can be removably attached to a putter, to aid the golfer to properly stroke the ball when practicing and which can be removed when actually playing a round of golf.

It is another object of the subject invention to provide a device to aid a golfer to properly stroke the ball when putting which can be retracted to facilitate storage of the putter in a golf bag.

DISCLOSURE OF THE INVENTION

The invention is a device for aiding a golfer to properly stroke the ball when putting with a club. A typical putting club (hereinafter called a putter) has a shaft with a gripping handle at one end and a head with a face for striking the ball thereon. In detail, the device comprises a support member for detachably mounting to the gripping end of the club, at substantially the end thereof. Preferably the support member is a collar made of a resilient material, having an aperature therethrough slightly smaller than the end of the shaft. This allows the collar to be expanded to fit over the end of the club and thereafter contract to grip the club. Alternately, the support member can be a belt, such as a Velcro belt.

An arm means is rotatably attached to the support member which when in use extends outward from the shaft in a direction at right angles to and in the opposite direction from the striking surface of the putter. The arm means being rotatively mounted, can be retracted by rotating it downward in alignment with the longitudinal axis of the shaft. This allows the club to be easily stored in a golf bag. Preferably, a detent means is incorporated which releasably holds the arm in the extended position or the retracted position.

The novel features which are believed to be characteristic of the invention, both as to its organization and method of operation, together with further objects and advantages thereof, will be better understood from the following description in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

Illustrated in FIG. 1 is a side view of a golfer addressing a golf ball with a putter incorporating the subject device.

Illustrated in FIG. 2 is an enlarged perspective view of the subject device mounted on the end of a putter.

Figure 2:
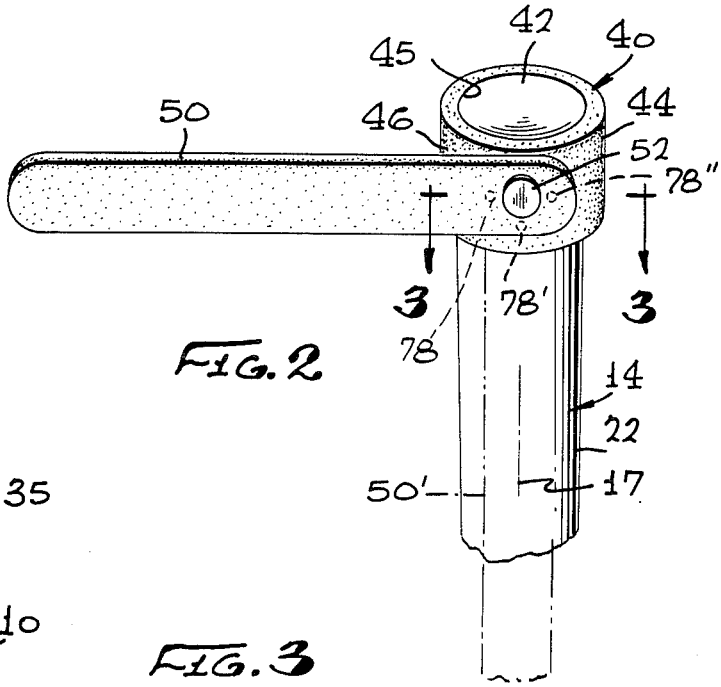
Figure 3:
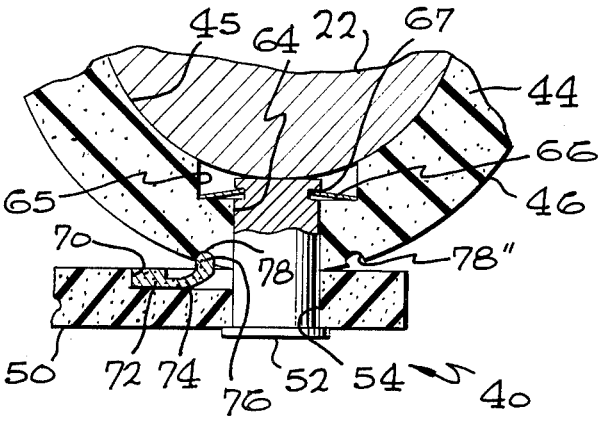

Illustrated in FIG. 3 is a cross-sectional view of the device shown in FIG. 2 taken along the line 3—3 particularly illustrating a detent system.

Figure 4:
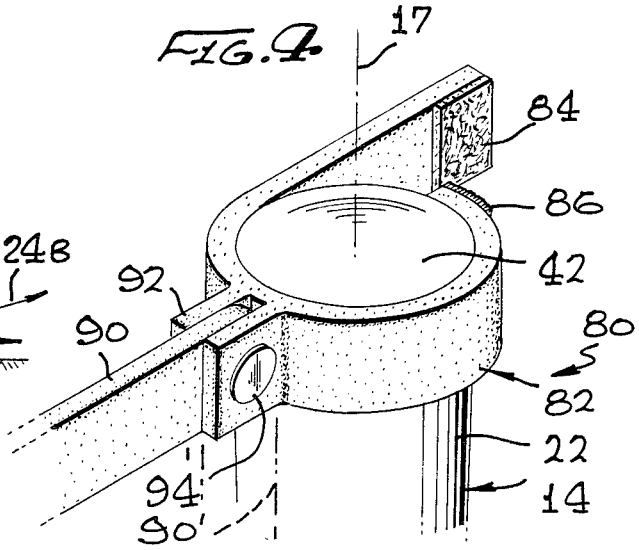

Illustrated in FIG. 4 is a partial perspective view of a second embodiment of the device particularly showing a second method of mounting the device to the putter.

BEST MODE FOR CARRYING OUT THE INVENTION

Figure 1:
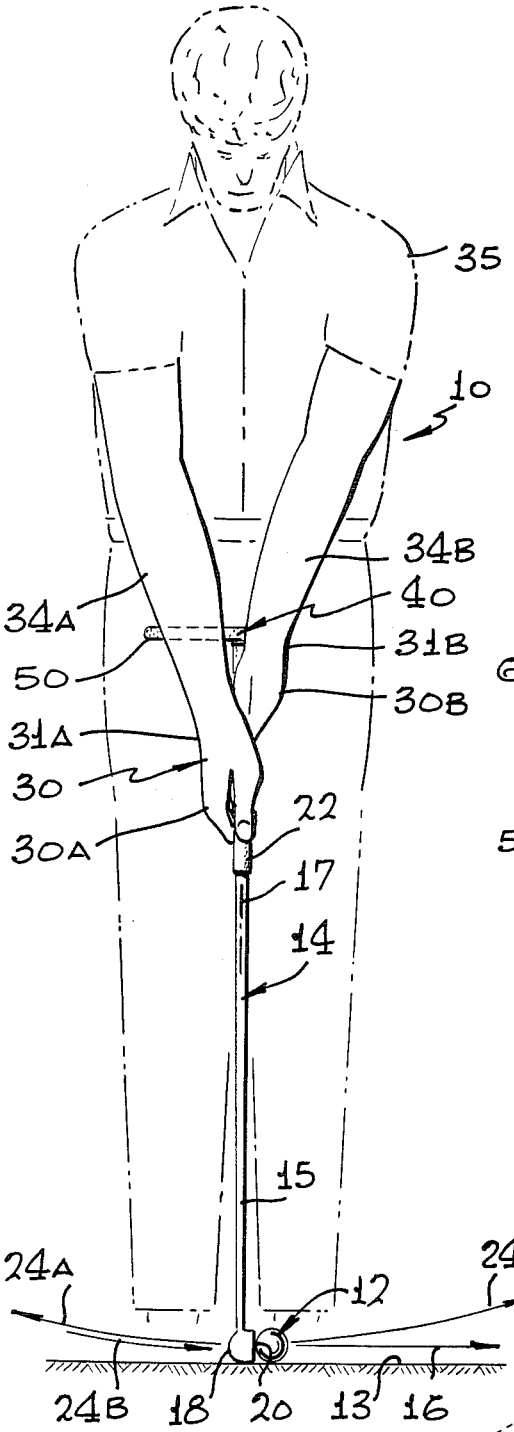

Illustrated in FIG. 1 is a view of a golfer addressing a golf ball at right angles to the projected path thereof. It can be seen that the golfer, generally designated by numeral 10, is about to putt the ball 12 lying on a putting green 13 using a putter 14. The desired path of the ball 12 is indicated by arrow 16. The putter 14 has a shaft 15 with a longitudinal axis 17. At one end is a head portion 18 with a face or striking surface 20 which when the club is properly positioned is perpendicular to the ball path 16. The putter 14 has a gripping portion 22 at the opposite end. A proper stroke would be in the path indicated by arrows 24A (pulling the club back), 24B (striking the ball) and 24C (the follow through).

The hands 30 hold the gripping portion 22 of the putter 14 in a conventional manner, i.e., the right hand 30A lower down the shaft 15 than the left hand 30B. This is a conventional stance and gripping technique and therefore need not be discussed in further detail. However, there is a tendency to rotate the wrists 31A and 31B which turn the hands 30 either to the right or left of the direction of the desired initial path 16 of the ball 12 such that the ball passes to the side of the cup (not shown). To prevent this, the golfer must practice keeping the arms 34A and 34B stiff and stroke using movement of the shoulders 35.

To aid the golfer in practicing the proper putting technique, Applicant has developed the subject device. Illustrated in FIG. 2 is an enlarged prospective view of the device installed on the end of the putter. Still referring to FIG. 1 and additionally to FIG. 2 it can be seen that the device, generally indicated by numeral 40, includes a support member mounted to the end 42 of the portion 22, i.e., the end of the putter 14. As illustrated the support member is in the form of a collar 44. The collar 44 includes an opening 45 slightly smaller than the end of the gripping portion 22 and preferably made of a resilient material such as rubber, so that it can be expanded and forced over the portion 22 with the application of only a slight force. The resilient nature of the collar 44 provides a positive positioning thereon. An arm 50 is rotatably attached to collar 44 at its periphery 46. The collar is mounted to the gripping portion 22 such that the arm 50 extends in a direction to the golfer's right, at right angles to the surface 20 of the head 18, i.e., a direction opposite to the desired direction of ball path 16.

Still referring to FIG. 2 and additionally to FIG. 3 which is a partial cross-sectional view of FIG. 2 taken along the line 3—3, it can be seen that the arm 50 is rotatably mounted to the collar 44 by means of a pin 52 extending through a hole 54 in the arm 50. The pin 52 further extends through a hole 64, having a counterbore 65, in the collar 44. The pin 52 is maintained therein by a lockwasher 66 mounted in a groove 67 in the pin 52. Thus, the arm can be rotated from the extended position as illustrated in solid lines to a retracted position aligned with the putters longitudinal axis 17 shown in dotted lines and indicated by numeral 50'.

The arm 50 incorporates a groove 70 in which is bonded a resilient detent member 72 having a flexible arm 74 with a protrusion 76 at the free end thereof. With the arm 50 in the extended position the protrusion 76 rides in a recess 78 in the collar 44. Thus, the arm is releasably held or locked in the extended position. When storing the putter 14 in a golf bag, the arm 50 can be rotated to the retracted position 50' at which point the protrusion engages a second recess 78' in the collar 44 (best illustrated in FIG. 2) and is again releasably held in place. A third recess 78'' is provided on the opposite side of the pin 60 so that the device can be used by left handed golfers, i.e., the arm 50 would be rotated 180° from the position indicated. It must be noted that other detent means can be used. For example, if the lockwasher 66 is of a spring loaded type it can be used to pull the pin 52 inward causing the arm 50 to tightly engage the collar 44 at its periphery 46 increasing the friction therebetween. Thus, the friction could also serve to hold the arm 50 in the desired positions.

Illustrated in FIG. 4 is a partial perspective view of an alternate design of the device, indicated by numeral 80 wherein the collar is in the form of a belt and as illustrated a Velcro fastener belt 82. Here, Velcro pads 84 and 86 are attached to each end of the belt 82. In this embodiment, the arm 90 is rotatably fastened to a clevice 92 mounted on the belt 82 by means of a pin 94 and thus extends radially outward from the longitudinal axis 17 of the putter 14. Thus, the arm 90 can also be rotated downward against the portion 22 for storage of the club (indicated in dotted lines and by numeral 90'). While most golfers may prefer the peripherial mounting of the arm as illustrated in FIGS. 1 and 2, some golfers will prefer the location as illustrated in FIG. 4. Furthermore, the arm 50 could be located opposite the side as illustrated in FIGS. 1 and 2. Clearly it is a matter of choice.

Referring back to FIG. 1 it can be seen that with the arm 50 extended and the hands 30 gripping the putter 14 in the conventional manner, the arm 34A rests against the arm 50 of the device 40. As the golfer strokes the ball the arm 50 supports the arm 34A. This tends to prevent the golfer's wrists 31A and 31B from breaking and the hands 30 rotating, which in turn keeps the arms 34 stiff and the swing is mostly accomplished by movement of the shoulders 35. Thus, the complete swing of the putter 14 indicated by numerals 24A, 24B and 24C is generally kept in the plane of the desired initial path 16 of the ball 12. It must be noted that in tournament play such a device would not be allowed; but in practice games and/or on practice greens the use of the device will "train" the golfer to maintain proper alignment of the club during putting. During actual play in a tournament the device can be easily removed.

While the invention has been described with reference to particular embodiments it should be understood that the embodiments are merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to the sport of golf as a teaching aid.

I claim:

1. In combination with a golf putter that includes a head portion having a face for striking the ball and a shaft having first and second ends, said first end of said shaft secured to said head and a gripping portion that extends inwardly from said second end thereof, a device for aiding the golfer to properly strike the ball when putting, the device comprises:

a support member mounted at substantially said second end of said shaft; and a generally linear arm mounted solely to and supported by said support member, and arm extending outwardly from said shaft in an opposite direction to said face and being of a length to support the arm of the golfer which is gripping the lower part of said gripping portion while the golfer's other arm is gripping the upper part of said gripping portion.

2. The combination as set forth in claim 1 wherein said support member is detachably mounted to said second end of said shaft.

3. The combination as set forth in claim 2 wherein said support member is a collar having an aperture, said collar adapted to fit over said second end of said shaft.

4. The combination as set forth in claim 3 wherein said arm is rotatably mounted to said support member and moveable from said outwardly extended position to a retracted position aligned with said shaft.

5. The combination as set forth in claim 4 wherein said device includes a detente to releasably hold said arm in said extended and retracted positions.

6. The combination as set forth in claim 5 wherein said arm is rotatably mounted to said periphery of said collar.

7. The combination as set forth in claim 5 wherein said arm is rotatably mounted to said collar, said arm extending radially outward from the longitudinal axis of said shaft when in said extended position.

8. The combination as set forth in claims 6 or 7 wherein said collar is a belt.

9. The combination as set forth in claim 8 wherein said belt incorporates a fastener means to secure said belt to said shaft.

10. The combination as set forth in claims 6 or 7, wherein said collar is made of a resilient material and said aperture is slightly smaller in size than said second end of said shaft such that said collar can be expanded over said second end of said shaft.

* * * * *